US008991315B2

(12) United States Patent
Koekemoer et al.

(10) Patent No.: US 8,991,315 B2
(45) Date of Patent: Mar. 31, 2015

(54) DETONATOR ASSEMBLY

(75) Inventors: Andre Koekemoer, Sandton (ZA); Craig Charles Schlenter, Sandton (ZA); Albertus A. Labuschagne, Sandton (ZA); Christopher Malcolm Birkin, Sandton (ZA); Herman Van Der Walt, Sandton (ZA)

(73) Assignee: Detnet South Africa (Pty) Ltd (ZA)

( * ) Notice: Subject to any disclaimer, the term of this patent is extended or adjusted under 35 U.S.C. 154(b) by 0 days.

(21) Appl. No.: 14/346,509

(22) PCT Filed: Jul. 11, 2012

(86) PCT No.: PCT/ZA2012/000048

§ 371 (c)(1),
(2), (4) Date: May 28, 2014

(87) PCT Pub. No.: WO2013/044273

PCT Pub. Date: Mar. 28, 2013

(65) Prior Publication Data

US 2014/0261039 A1 Sep. 18, 2014

(30) Foreign Application Priority Data

Sep. 23, 2011 (ZA) ..... 2011/06962

(51) Int. Cl.

| | |
|---|---|
| ***F42D 1/04*** | (2006.01) |
| ***F42B 3/10*** | (2006.01) |
| ***F42C 11/06*** | (2006.01) |
| ***F42D 1/055*** | (2006.01) |

(52) U.S. Cl.

CPC . *F42D 1/04* (2013.01); *F42D 1/055* (2013.01)

USPC ..... 102/206; 102/201; 102/215; 102/217; 102/275.5; 102/275.6

(58) Field of Classification Search

USPC ..... 102/200, 201, 202.5, 206, 215, 217, 102/275.1, 275.5, 275.6, 275.8

See application file for complete search history.

(56) References Cited

U.S. PATENT DOCUMENTS

| | | | | |
|---|---|---|---|---|
| 5,007,661 | A | 4/1991 | Lenzen | |
| 5,435,248 | A * | 7/1995 | Rode et al. | 102/210 |
| 7,778,006 | B2 * | 8/2010 | Stewart et al. | 361/248 |
| 7,929,270 | B2 * | 4/2011 | Hummel et al. | 361/249 |
| 8,261,663 | B2 * | 9/2012 | Perez Cordova et al. | 102/215 |
| 8,857,339 | B2 * | 10/2014 | Muller et al. | 102/206 |

(Continued)

FOREIGN PATENT DOCUMENTS

| | | | |
|---|---|---|---|
| DE | 4015045 | A1 | 11/1990 |
| WO | 9415169 | A1 | 7/1994 |

OTHER PUBLICATIONS

International Preliminary Report on Patentability for PCT/ZA2012/000048, international filing date of Jul. 11, 2012, mailed Sep. 13, 2013, 12 pages.

International Search Report for PCT/ZA2012/000048, international filing date of Jul. 11, 2012, mailed Nov. 26, 2012, 4 pages.

(Continued)

*Primary Examiner* — James S Bergin

(74) *Attorney, Agent, or Firm* — Cantor Colburn LLP

(57) ABSTRACT

A detonator assembly (10) which includes a housing (16), an explosive (20) in the housing (16), an initiating element (32) exposed to the explosive (20), a circuit for controlling operation of the initiating element (32), and a communication arrangement which can establish communication between the circuit and an external controller (60) at least at one optical frequency.

8 Claims, 2 Drawing Sheets

(56) References Cited

U.S. PATENT DOCUMENTS

| | | | | |
|---|---|---|---|---|
| 2011/0155012 | A1 | 6/2011 | Perez Cordova et al. | |
| 2013/0255520 | A1* | 10/2013 | Muller et al. | 102/201 |
| 2013/0319276 | A1* | 12/2013 | Muller et al. | 102/202.7 |

OTHER PUBLICATIONS

Written Opinion for PCT/ZA2012/000048, international filing date of Jul. 11, 2012, mailed Nov. 26, 2012, 5 pages.

* cited by examiner

DETONATOR ASSEMBLY

CROSS-REFERENCE TO RELATED APPLICATIONS

This application is a U.S. national stage application of International Application No. PCT/ZA2012/000048 entitled "DETONATOR ASSEMBLY", which has an international filing date of 11 Jul. 2012, and which claims priority to South African Patent Application No. 2011/06962, filed 23 Sep. 2011.

BACKGROUND OF THE INVENTION

This invention relates to a detonator assembly.

An electronic detonator holds advantages, over other detonator types, in that, inter alia, it allows for flexibility in programming of the operation of the detonator and, in particular, the detonator is capable of executing accurately a timing interval, even of millisecond duration.

Normally use is made of electrical conductors, e.g. in a two-wire or four-wire configuration, to interconnect a plurality of electronic detonators thereby to establish a blasting system. The cost of the electrical conductors, typically made from copper, can be relatively high and, at least for this reason, increasing attention has been paid to interconnecting electronic detonators using signal tubes (also referred to as "shock tubes") in order to make up a blasting system.

A shock tube is robust and relatively inexpensive and possesses a number of advantages over electrical conductors. In a blasting system which is based on the use of a number of electronic detonators interconnected by means of shock tubes, an electrically conductive path is however not established between the detonators and an external device such as a blasting machine or tagger. Each detonator must be capable of withstanding the effects of pressure produced when adjacent detonators ignite respective explosive charges. For this reason a detonator housing is normally made from a metal such as aluminium or copper. Unfortunately the metallic housing is, inherently, electrically conductive and acts as an electromagnetic shield. This feature makes it difficult, in a shock tube-based system, to establish reliable communication links between a communication circuit inside a detonator housing and an external device.

A need exists for a means of establishing communication between an external device and a communication circuit inside a detonator housing without making an electrically conductive connection between the external device and the communication circuit.

SUMMARY OF THE INVENTION

The invention provides a detonator assembly which includes a housing, an explosive in the housing, an initiating element exposed to the explosive, a circuit for controlling operation of the initiating element, and a communication arrangement which can establish communication between the circuit and an external controller at least at one optical frequency.

As used herein "optical frequency" includes infrared, visible, and ultraviolet, frequencies. An infrared frequency is regarded as falling in the frequency range of 300 GHz to 400 THz. A visible frequency lies in the range of 400 THz to 790 THz and an ultraviolet frequency lies in the range of 790 THz to 1580 THz.

In a preferred form of the invention however the optical frequency lies in the visible or infrared frequency range.

Signal sources and signal sensors which operate reliably at visible (light) or infrared frequencies are readily available and relatively inexpensive.

Communication which is established by the communication arrangement can be unidirectional, e.g. to or from the circuit in the detonator, or bidirectional i.e. to and from the circuit in the detonator. The invention is not limited in this respect.

The communication arrangement may take on any suitable form. If communication takes place from the circuit to an external device, e.g. a controller, then the detonator preferably includes at least one signal generator which operates at an optical frequency, for example a light source. Communication may be achieved by modulating an output of the signal generator. To enable the signal to be transmitted from within the housing so that it can be detected outside the housing at least one communication path is established.

In one preferred form of the invention a signal propagation device such as a shock tube is connected to the housing using a plug. It then falls within the scope of the invention, in order to establish the communication path, for at least one of the signal propagation device (shock tube) or part thereof, and the plug, to be capable of transmitting a signal at an optical frequency i.e., in the preferred form of the invention, of being capable of transmitting a light signal.

Similarly, if communication is to be effected from the external device to the circuit then the signal propagation device (shock tube) and the plug, or at least one of these components, should be capable of acting as a medium to transfer a communication signal, suitably modulated, at an optical frequency.

If bidirectional communication is to take place then a signal to the circuit in the detonator may be transferred at a first frequency and a signal from the circuit may be transferred at a second frequency which is different to the first frequency.

If communication takes place from the external device to the circuit then the communication arrangement may include at least one sensor for detecting an incoming signal at a chosen optical frequency. If the optical frequency is in the visible light region then the sensor may comprise at least one light sensor.

The signal propagation device (shock tube) is typically coloured. The operating frequency at which communication takes place may be chosen to be compatible with the colour of the shock tube so that undue attenuation of the signal does not occur when the signal impinges on the shock tube. Similarly, the plug may have a colour or any other suitable optical characteristic which is chosen to enhance signal propagation.

The circuit within the detonator housing may be embedded, at least partly, in a light transmissive material e.g. a suitable plastics material. The light transmissive material is chosen to have minimal attenuation of a signal, in the material, at a particular, or working, optical frequency. A light source impinging on this type of material is reflected at boundaries of the material with the atmosphere or a surrounding environment and, effectively, the material is fully internally illuminated by the light. This substantially facilitates detection of a light signal by one or more sensors which are, preferably, also embedded in this material.

The external device e.g. a controller may include an interface unit which is adapted to receive the detonator housing in a predetermined relationship. The detonator housing may be engageable with the interface unit. The interface unit may include a formation which ensures that the detonator housing takes up a desired position or orientation when the detonator is engaged with the interface unit. In this position or orientation communication at a desired optical frequency is enhanced or facilitated. The interface unit may for example include one or more sensors which are automatically positioned against the shock tube or the plug, at a desired position, when the detonator housing is engaged with the interface unit.

BRIEF DESCRIPTION OF THE DRAWINGS

The invention is further described by way of example with reference to the accompanying drawings in which.

DESCRIPTION OF PREFERRED EMBODIMENTS

Figure 1:
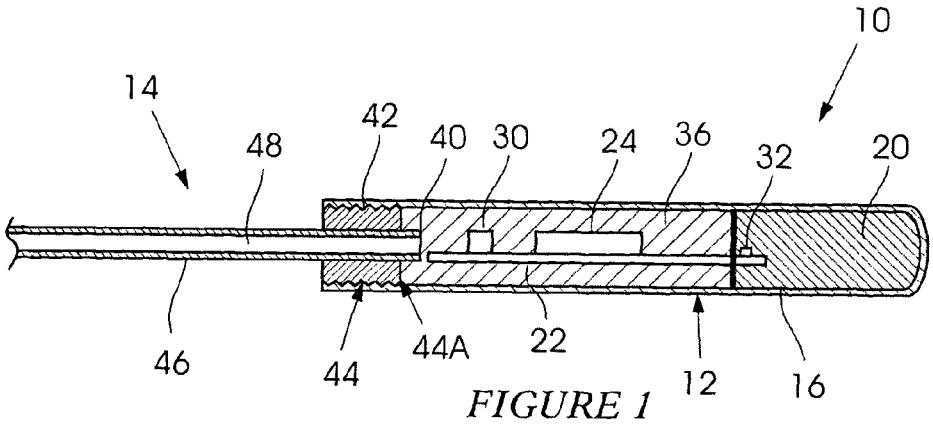
FIG. 1 is a side view of a detonator assembly according to one form of the invention.

FIG. 1 of the accompanying drawings illustrates from one side and in cross-section a detonator assembly 10 according to the invention which includes a detonator 12 connected to a shock tube 14.

Figure 3:
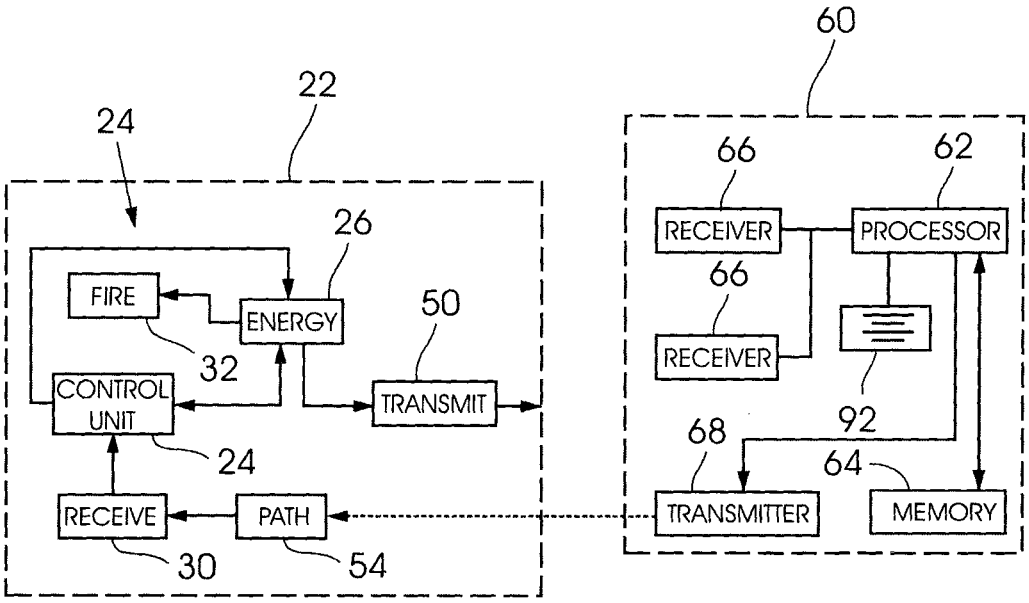
FIG. 3 illustrates some circuit diagram aspects of a detonator assembly according to FIG. 1 interacting with an external controller.

The detonator 12 includes a tubular metallic housing 16, e.g. of copper or aluminium, which contains a quantity of explosive 20. A printed circuit board 22 is located inside the housing. The printed circuit board carries a control unit 24, a small battery 26 (the battery is shown in FIG. 3 and not in FIG. 1) and a sensor 30 which is operative at light frequencies—visible or infrared according to design. An initiating element 32 is designed to dissipate electrical energy, as is known in the art, under controlled conditions, and thereby cause initiation of the explosive 20. This aspect is not further described herein.

Most of the printed circuit board, including the sensor 30, is embedded in transparent, possibly coloured, plastic material 36. The sensor 30 is responsive to an optical frequency which has a given wavelength and the colour of the plastic material is transparent to the same wavelength. This is to enhance the sensitivity of the arrangement inside the detonator housing to incoming light of the appropriate frequency.

The shock tube 14 is of a conventional construction. The shock tube has an inner end 40 which directly opposes the sensor 30. The shock tube is surrounded by a plug 42 which is fixed to the housing 16 by means of a crimping process 44 at a mouth of the tube. The plug serves a number of functions. Firstly, it is used to secure the shock tube in a desired orientation to the housing 16. Secondly, the plug provides a watertight and essentially gas-proof seal between the interior of the housing and atmosphere. Thirdly, the plug is made from material which is light-transmissive. Preferably the material from which the plug is made has a colour similar to the colour of the plastic material 36.

The shock tube has a tubular construction with an outer flexible sheath 46 surrounding an elongate passage 48. A wall of the passage (an inner wall of the sheath) is covered, usually, with a material known in the trade as Surlyn. It has been established through tests that a typical shock tube although, ostensibly, opaque nonetheless is capable of allowing light to propagate through its walls. A light beam aimed at an external surface of the shock tube is capable of penetrating the thickness of the sheath and of entering the passage 48. The light inside the passage can then propagate to some extent along the length of the passage. Alternatively or additionally the light propagates along the sheath of the shock tube.

FIG. 3 illustrates a typical circuit carried by the printed circuit board 22 inside the detonator. The control unit 24 is microprocessor or logic-based and is connected to an energy source 26 which is a suitable battery. The sensor 30 shown in FIG. 1 is treated as a receiver which is operative efficiently at a given light frequency. A transmitting device 50 is included in the circuit. The device 50 is shown as being separate from the receiver or sensor 30 but this is for illustrative purposes only. It is possible to make use of a configuration in which the sensor 30 is usable to receive a signal at an optical frequency and to transmit a signal at an optical frequency. An example embodiment of such a sensor and transmitter combination is a light emitting diode. Optionally the transmit and receive frequencies are different to facilitate aspects of communication. Optionally, communication is either only in a transmit mode, or only in a receive mode, at an optical frequency, and communication in the opposite direction is accomplished by alternative means such as magnetic or RF communications.

FIG. 3 illustrates a communication path 54 in a notional manner. As is explained hereinafter the communication path is constituted by the plug 42 and the plastic material 36. The communication may also be effected via the shock tube sheath or passage.

The detonator assembly 10 is intended to be used with an external controller 60 which includes a processor 62, a memory 64, a number of light sensors or receivers 66 and at least one transmitter 68 which operates at an optical frequency. Again it is possible for the sensors to double-up as light transmitters, if necessary. However in FIG. 3 the receivers and transmitters are shown as being separate components.

Figure 2:
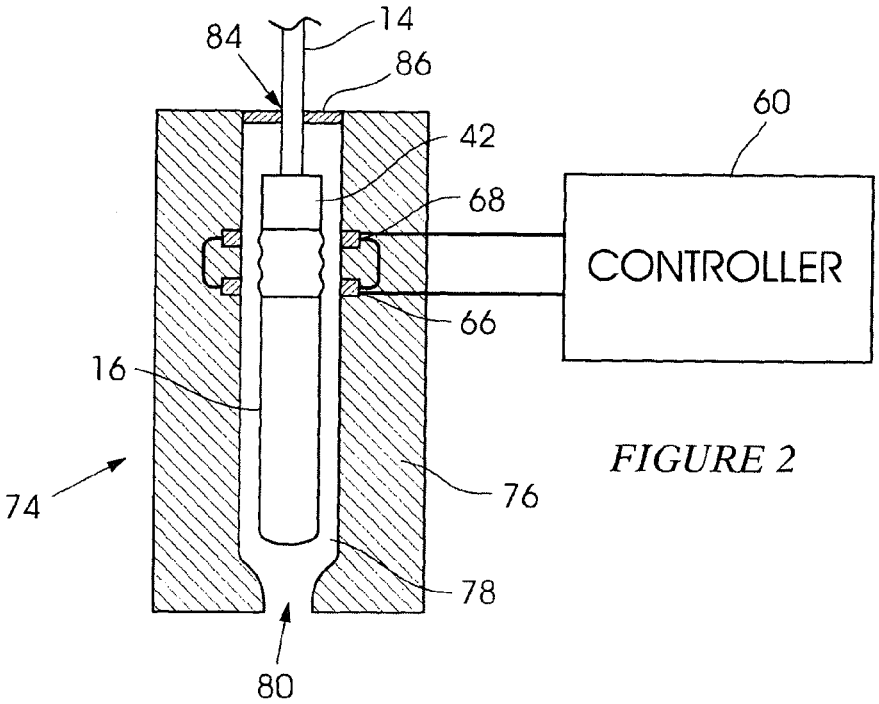
FIG. 2 illustrates one mode of communicating with the detonator assembly of FIG. 1.

The external controller 60 is shown in FIG. 2 linked to an interface unit 74. The interface unit includes a body 76 which can be handled by means of an operator or which is attached in a secure manner to an appropriate support structure, for example a casing of the controller 60. The body 76 is formed with an elongate passage 78 which is shaped so that the detonator housing 16 can be positioned with only a small degree of play inside the passage. The passage has a tapered end 80 which prevents the housing 16 from passing completely through the passage and which ensures that the detonator housing takes up a desired position when the housing is inserted into the passage.

The receivers 66, shown in FIG. 3, are positioned in a closely packed array inside the body 76 around the passage 78. When the detonator housing is correctly inserted into the body 76 the receivers 66 are close to the plug 42 of the detonator assembly. The transmitter 68 is also located in the body. The shock tube 14 extends away from the body 76 and passes through an aperture 84 in a flexible shroud 86, which permits the detonator housing to be inserted into the body 76 with the shroud deflecting. The shroud then automatically, under its inherent and natural resilience, springs back and abuts an outer surface of the shock tube effectively preventing the ingress of light through the aperture 84 into the passage 78.

The shock tube 14 is used in a conventional manner to propagate a signal to the detonator thereby to cause ignition of the element 32. Coding, synchronizing, timing and related control functions are implemented by means of the circuit 24. The function of the external controller 60 is to enable communication to take place with the circuit 24. For example, data from the memory 64 may be transferred to the circuit 24 and used to control the firing operation of the detonator. Similarly, data can be transferred in the reverse direction, from the detonator to the processor, for validation and other operational and control purposes. These aspects are not elaborated on herein.

In order for communication between the detonator assembly and the external controller to be effected use is made of communication techniques carried out at optical frequencies.

A battery 92 carried by the controller 60, or any other power source associated with the controller, is used, regulated by the processor 62, to generate light energy at a fairly high level via the transmitter 68. This light energy is modulated as appropriate, using conventional techniques, so that data can be carried by the light signal. The emitted light signal is directed to the path 54 i.e. onto the plug 42 and a part of an external surface of the shock tube 14, inside the passage 78 in the body 76. The light impinging on the plug is emitted, inter alia, from a surface 44A which faces into the interior of the housing 16—see FIG. 1. Similarly, light conveyed inside the shock tube, either along the length of the passage 48 or inside the material of the sheath 46, is directed from the end 40 towards the sensor 30. Light impinging on the plastic material 36 internally illuminates the material for it is refracted or reflected from a surface of the material at an interface between the body of the material and a surrounding environment. The sensor 30 is thus effectively exposed to the light signal and data carried by the light signal can be extracted therefrom by the control unit and used for operational purposes of the detonator.

In the reverse direction the energy source 26 is used to power and modulate the transmitter 50 which, as noted, may well be the same as the receiver 30. The light which is emitted, internally illuminates the plastic material 36 and some of the light is transferred to the plug 44 via the surface 44A which faces onto the material 36. Additionally, light enters the shock tube 14 either via the passage 48 or inside the sheath material. Normally the light in the reverse direction (from the detonator to the external controller) is significantly less energetic than in the forward direction due to constraints imposed by the energy source 26. For this reason, at least, it is preferred to make use of a plurality of sensors 66 correctly and closely positioned around the plug so that the energy which is emitted is effectively captured by the receivers. The light signal from the detonator is decoded by the processor 62 and, depending on operational parameters, the status or any other aspect of the detonator assembly is assessed.

The quantity of energy which is available from the battery or energy source 26 associated with the detonator is limited and, typically, the detonator circuit is kept in a sleeping mode for an extended period only to be "awakened" when the detonator is to be interrogated or placed in an operational mode. Operation of the light emitting transmitter 50 (typically a light sensor) usually requires a relatively large quantity of energy. To enhance the communication capability a certain quantity of energy can be transferred at light frequencies from the controller to the detonator assembly. For example, the detonator assembly may include a battery used for data processing and similar purposes and a storage capacitor which is used for higher energy consumption activities and which is charged by converting light energy input via the receiver/transmitters in the body 76 to the detonator assembly.

Figure 4:
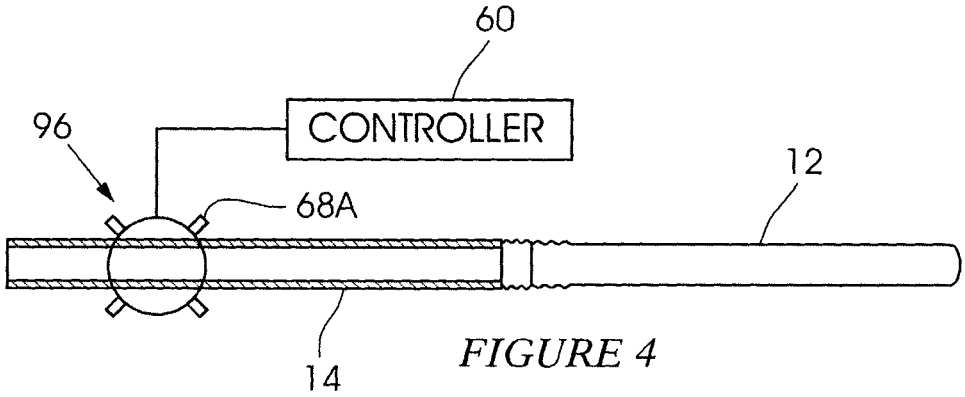
FIG. 4 illustrates a different way of communicating with the detonator assembly.

It is preferred to have close coupling between the detonator assembly and the external controller, generally in the manner shown in FIG. 2. It is however not essential to make use of this technique for the capability of transferring data at a light frequency between an external source and the detonator assembly is dependent, at least, on the sensitivity of the various components. FIG. 4 for example shows an arrangement in which the controller 60 is coupled at a location 96 to a shock tube 14. The location 96 is, relatively speaking, a considerable distance from a detonator 12 which, generally, is of the kind described in connection with FIG. 1. The controller may input energy, at a light frequency, into the shock tube via a plurality of transmitters 68A which are circumferentially spaced around the tube. Light energy entering the shock tube can effectively be conveyed over a fairly substantial distance to the detonator, for detection by one or more sensors inside the detonator. Similarly, a light signal emitted by the detonator can be transferred into the shock tube for detection at the location 96. This arrangement could be used to communicate with a detonator after it has been deployed in a blast hole, via a control unit which is outside of the blast hole e.g. located on surface.

The invention claimed is:

1. A detonator assembly which includes a housing, an explosive in the housing, an initiating element exposed to the explosive, and a circuit for controlling operation of the initiating element, wherein the detonator assembly includes a communication arrangement which can establish a bidirectional communication between the circuit and an external controller at least at one optical frequency, a shock tube connected to the housing by a plug, and at least one of the shock tube and the plug is capable of transmitting signals of the bidirectional communication.

2. A detonator assembly according to claim 1 wherein the optical frequency is in the range of 300 GHz to 790 THz.

3. A detonator assembly according to claim 1 or claim 2 wherein the communication arrangement includes at least one sensor for detecting a signal at an optical frequency.

4. A detonator assembly according to claim 3 in combination with an interface unit which is engageable with the detonator housing wherein the interface unit includes one or more sensors which are responsive to a signal at the optical frequency, and which are automatically positioned against at least one of the shock tube and the plug when the detonator housing is engaged with the interface unit.

5. A detonator assembly according to claim 3 wherein the circuit within the detonator housing is embedded, at least partly, in a light-transmissive material.

6. A detonator assembly according to claim 1 or claim 2 wherein the circuit within the detonator housing is embedded, at least partly, in a light-transmissive material.

7. A detonator assembly according to claim 1 wherein at least one of the shock tube and the plug is coloured to reduce attenuation of the signal at the optical frequency.

8. A detonator assembly according to claim 7 wherein the circuit within the detonator housing is embedded, at least partly, in a light-transmissive material.

* * * * *